United States Patent [19]

Wiese

[11] 4,188,601

[45] Feb. 12, 1980

[54] MERCURY-WETTED RELAY CONSTRUCTION

[75] Inventor: Larry L. Wiese, Pickerington, Ohio

[73] Assignee: Bell Telephone Laboratories, Incorporated, Murray Hill, N.J.

[21] Appl. No.: 951,123

[22] Filed: Oct. 13, 1978

[51] Int. Cl.[2] ..... H01H 29/00

[52] U.S. Cl. ..... 335/51; 335/55; 335/58

[58] Field of Search ..... 335/49, 51, 55, 57, 335/58, 154, 274, 276, 236

[56] References Cited

U.S. PATENT DOCUMENTS

| | | | |
|---|---|---|---|
| 3,317,869 | 5/1967 | Funke | 335/154 |
| 4,134,088 | 1/1979 | Asbell et al. | 335/55 |
| 4,149,130 | 4/1979 | Lacis | 335/55 |

*Primary Examiner*—George Harris
*Attorney, Agent, or Firm*—William H. Kamstra

[57] ABSTRACT

A mercury-wetted relay construction is disclosed in which a substantially flattened "Z" shaped armature (20) is mounted by means of a flexible hinge (19), at one side of the stem (11) to extend in an overlapping and spaced-apart relation with a contact (16) mounted on the other side of a pole-piece (12), the armature (20) thereby crossing the common longitudinal axis of the stem and pole-piece. An armature oscillation dampening bumper (23) is affixed to the other side of the stem (11) which extends parallel and in a spaced relation with the armature (20) at the contact end. Because of the operating direction of armature (20), the latter member may be abutted against the stem (11) end to reduce to a minimum the magnetic reluctance at this juncture.

8 Claims, 1 Drawing Figure

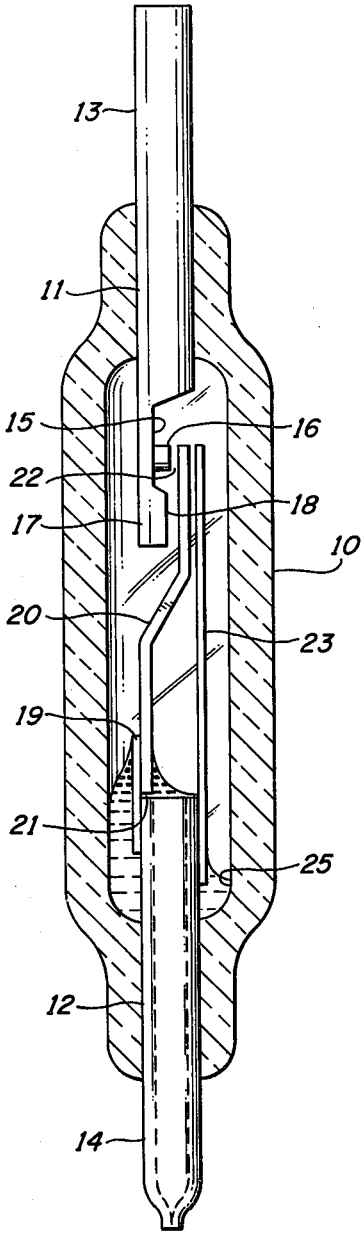
13
11
15
16
22
18
17
10
20
23
19
21
25
12
14

MERCURY-WETTED RELAY CONSTRUCTION

TECHNICAL FIELD

This invention relates to electromagnetically actuated electrical relay constructions and particularly to such relay constructions having mercury-wetted contact elements sealed in an enclosing envelope.

BACKGROUND OF THE INVENTION

Sealed contact relays are well known in the electrical arts and have long found extensive application in electrical systems for performing a wide range of switching functions. A typical dry reed form of such relays comprises a pair of overlapping reed springs of a magnetically responsive and electrically conductive material suspended at their ends by an envelope, usually glass, in which they are sealed. A winding encircling the envelope is energized to generate a magnetic field for actuating the reed springs to control the electrical circuit in which the relay is connected. Such dry reed relays have served well in particular circuit applications; the character of their contact surfaces, however, renders them essentially current limited. Minute imperfections on the contact surfaces reduce the areas of electrical contact to less than the entire surface of the contact. As a result, currents of a magnitude beyond a predetermined limit tend to cause melting at the contact areas, which, in turn, increases the tendency of the contacts to stick closed after actuation. To counteract this tendency, greater reed spring retractile forces are required which increase the amount of magnetic flux and, therefore, coil current required.

When larger current carrying capacities are required, this problem has been largely overcome by the employment of the well-known mercury-wetted relay. Typically, the construction of such a relay comprises a contact-mounting pole-piece suspended at one end of a glass envelope and a substantially coaxial stem suspended at the other end, each of the elements extending partially into the envelope from its ends. Connected to the stem by means of a flexible hinge is an armature dimensioned to overlap in a spaced-apart relation with the pole-piece contact. The surfaces of the opposing contact and armature face are coated with a film of mercury. When these surfaces meet upon energization of the relay, electrical connection is uniformly established over the entire contact surfaces. As a result, the magnitude of the currents carried by the relay required to cause contact surface melting is significantly increased. As a further and important result, the current values necessary to actuate the relay are substantially reduced. Since the force required to separate the contacts need not contend with contact melting, the stiffness of the armature or, more precisely, its hinge, may be substantially less than that of the dry reed relay counterpart. The lower limit of armature hinge stiffness of a mercury-wetted relay is determined only by the requirement that the armature restoring force be sufficient to overcome the mercury surface and viscous forces and hence rupture the mercury bridge between the contacts. This lower armature hinge stiffness therefore allows mercury-wetted switches to require lesser magnitudes of magnetic flux for their operation than their dry reed counterparts while having substantially improved load switching capabilities. Although broadly similar in structure and function to their dry reed counterparts, practical aspects of the fabrication and operation of mercury-wetted relays have resulted in structural arrangements and problems peculiar to such relays.

One such problem, for example, results from the greater flexibility of the armature member hinge which increases the tendency for oscillation of the member after its release. Such oscillation ordinarily presents little difficulty in dry reed relays as long as the first (and greatest) return swing falls short of re-establishing electrical contact. In the case of mercury-wetted relays, release of the electrical contacts requires the rupturing of a mercury bridge at the contact area as mentioned hereinbefore. This initially leaves a "pillow" of mercury at the pole-piece contact with which electrical contact may be re-established at the first return swing of the contacting member in a release oscillation, thereby producing undesirable contact bounce. As a result, prior art mercury-wetted relay constructions provide some means for dampening such oscillations. In one well-known arrangement, for example, the armature contacting member is positioned with respect to its enclosing glass envelope so that contact with the inside of the latter envelope is made to shorten the first and succeeding swings to dampen the oscillation. However, a disadvantage of this method is that precise control of the spacing between the armature and the glass is difficult to achieve in manufacture.

Another consideration in the construction and operation of a mercury-wetted switch is the achievement of proper response to the application of a given operating magnetic field. Both the armature assembly stiffness and the reluctance of the flux closure path through the relay elements are important factors in determining this relay sensitivity. In many prior art constructions, obtaining tight control over the armature assembly stiffness has been a problem in manufacture because the location of the points at which the hinge is affixed to the stem and to the armature must be precisely controlled and the hinge must not come in contact with either the armature or the stem in the region between these points of attachment when the switch is operated. Otherwise the stiffness, and hence the magnetic flux required for operation, will be increased. One critical point in the flux closure path governing its reluctance is the hinge juncture between the armature member and the face of the stem. Because of the thin cross-section required to obtain low stiffness, the hinge can carry only part of the magnetic flux required to operate the switch, the majority being shunted across the gap between the armature and the stem face.

Another factor influencing the operate sensitivity of miniature mercury switches relates to the proper drainage of mercury back into the reservoir following shipment or handling. When mercury is transferred from the reservoir to the space between the armature member and the envelope, surface tension forces pull the armature toward the envelope unless mechanically restrained, thereby increasing the magnetic gap and the magnetic flux required for operation. In severe cases the switch may even fail to operate. Accordingly, objectives in the design of the switch for mercury-wetted relays include: minimization of the armature stem-gap reluctance; an armature assembly design which facilitates the control of stiffness in manufacture; an easily manufacturable method for minimizing the armature oscillation following release; and minimization of mercury drainage problems which could adversely affect the operate sensitivity of the relay. It is to the foregoing and other problems in the fabrication of mercury-wetted relays that the construction of this invention is directed.

SUMMARY OF THE INVENTION

An improved mercury-wetted relay construction directed to the aforementioned operating considerations is provided in accordance with this invention in which, in one illustrative embodiment, the armature comprises an essentially flattened "Z" shaped member of the general character disclosed, for example, in the U.S. Pat. of R. A. Funke, No. 3,317,869, issued May 2, 1967. When viewed in a horizontal position of the relay, the lower leg of the armature of the present invention is mounted on the lower surface of the relay stem by means of a flexible hinge. Advantageously, this armature assembly design facilitates improved stiffness control because flexure of the armature assembly in the direction of normal switch operation increases rather than decreases clearances between the hinge and the stem or armature in the region between points of attachment. The stem itself is conventionally suspended in and extended through one end of the glass envelope. The upper and opposite leg of the armature extends over and in a spaced-apart relation with a contact borne on a flattened upper surface of the relay pole-piece which is also conventionally suspended in and extended through the other end of the glass envelope. Advantageously, this mounting of the relay armature permits a reduction of the armature-stem gap, and thereby its reluctance, to the point where a virtual abutment of these members is permitted since any operative movement of the armature increases the clearance between these members. In accordance with another aspect of this invention, an oscillation-dampening bumper member is affixed to the upper surface of the relay stem to extend in a spaced relation with the upper leg of the armature along the surface opposite from that facing the relay contact. The bumper member has a mercury-nonwettable surface to prevent any accumulation of mercury between its surfaces and those of the enclosing envelope and armature on either side. Advantageously, the bumper also prevents drainage problems which adversely affect relay sensitivity by preventing the armature from being pulled toward the glass. Moreover, since the bumper occupies a significant fraction of the volume into which mercury might be thrown and its nonwetting nature tends to exclude mercury from that side of the switch, axial shock tends to throw mercury from the reservoir either down the contact side of the armature or into the pocket formed by the offset formed into the armature. Also, since the bumper is mounted on the stem the need for locating the armature assembly precisely with respect to the envelope as was done previously in one prior art mercury-wetted switch is eliminated, thereby facilitating manufacture of the device. The contact may advantageously be mounted in a pole-piece recess to provide a reluctance reducing flux concentrator pole-piece extension of the character described in the co-pending application of W. E. Asbell et al., Ser. No. 793,123, filed May 2, 1977, now U.S. Pat. No. 4,134,088.

BRIEF DESCRIPTION OF THE DRAWING

The features and advantages of a mercury-wetted relay construction according to the principles of this invention will be better understood from a consideration of the detailed description of the organization and operation of one illustrative embodiment thereof which follows when taken in conjunction with the accompanying drawing, the single FIGURE of which shows in lengthwise cross-section view the elements making up the relay organization, the view being considerably enlarged to clarify the details.

DETAILED DESCRIPTION

One illustrative mercury-wetted relay construction according to this invention is depicted in the single FIGURE of the drawing in which construction the operating elements are conventionally sealed in a glass envelope 10. These elements, which are in practice arranged for vertical mounting as shown, comprise an upper pole-piece 11 and a lower stem 12. Elements 11 and 12 are formed of an electrically conductive, magnetically responsive material and extend externally from opposite ends of envelope 10 to comprise end terminals 13 and 14, respectively. Pole-piece 11 and stem 12, which may be circular in cross-section, lie in a substantially common longitudinal axis, and pole-piece 11 is internally formed to present a recess 15 presenting a flattened surface on which an electrical contact 16 is affixed in any suitable manner. Pole-piece 11 extends beyond recess 15 and contact 16 to form a flux concentrator section 17, the recess 15 terminating to form an outwardly extending projection 18, the surface of which is also flattened and substantially coplanar with the surface of contact 16. Stem 12 has affixed thereto at a side opposite to the corresponding contact 16 side of pole-piece 11, a hinge 19. The latter hinge extends upwardly from stem 12 and has, in turn, similarly affixed thereto in any suitable manner such as by welding, a flattened "Z" shaped armature member 20. At its hinged end, the lower leg of armature member 20 is disposed virtually in abutment with the face of stem 12, leaving a slight gap 21 to ensure clearance for armature member 20 movement. Moving upwardly along the lateral offset of armature member 20, the upper leg of the latter member is seen to overlap surface 18 of pole-piece 11 and the surface of contact 16 and is spaced apart from the latter surface to present a contact-armature gap 22. According to one feature of a switch according to this invention, the other side of stem 12 has affixed thereto in any convenient manner, such as by welding, an armature oscillation dampening bumper member 23. Bumper member 23, which may be of, for example, rectangular or circular cross-section, extends upwardly to the end of armature member 20, approximately parallel thereto and in a spaced relationship therewith. Conventionally, the lower portion of envelope 10 constitutes a reservoir for mercury as represented at 25. The entire surfaces of armature member 20 and its hinge 19 are mercury coated from reservoir 25 by capillary action. Except for the surface of contact 16, the entire end of pole-piece 11 and the entire surface of bumper member 23 are rendered nonwettable by mercury by means such as chrome-oxide plating, thereby preventing any mercury wetting during fabrication or subsequent operation, leaving only the contact surface and armature member 20 surfaces wetted. The interior of envelope 10 has conventionally further sealed therein a suitable gas, such as hydrogen, for preventing oxidation and selected with a view to possible breakdown voltages appearing across the open contact elements of the relay. Armature member 20 and its hinge 19 are also formed of a suitable electrically conductive, magnetically responsive material, armature 20 being dimensioned to present a low reluctance path for magnetic flux during the operation of the relay to be considered hereinafter. For reasons which will become apparent, bumper member 23 is formed of a magnetically nonresponsive material such as, for example, nonmagnetic stainless steel. Hinge 19 presents a magnetic low reluctance path; its dimensions are such, however, that in order to provide sufficient flexibility and thereby armature sensitivity, gap 21 acts as a supplemental, albeit higher, reluctance path for the magnetic flux operating armature 20. Advantageously, in accordance with the relay construction of this invention, the manner in which armature member 20 is operated permits a maximum reduction of gap 21 to virtually an abutment of the facing members, thereby reducing the gap reluctance to a minimum.

Conventionally, one of the elements 11 and 12 (here stem 12) is hollow to permit access to the interior of envelope 10 for the introduction of mercury and the enclosed gas after which the element is appropriately sealed. In practice, envelope 10 is encircled by an energizing winding bobbin, not shown, the entire assembly being enclosed in a magnetic enclosure, also not shown. Since the functions of these elements are well known in the art, they need not be described in detail for an understanding of the present invention.

With the afore-described organization of an illustrative mercury-wetted relay construction according to this invention in mind, an exemplary operation thereof may now be considered. In the drawing, relay armature member 20 is shown in its normal, unoperated state thereby presenting a substantially equal gap between its surface opposing contact 16 and the surfaces of the latter contact and surface 18 of the flux concentrator projection 17. Upon energization of the relay winding, not shown in the drawing, a magnetic field is conventionally generated through envelope 10 which may be assumed as passing in an upward direction as viewed in the drawing. This field, in finding a closure path, follows that of least reluctance which may be traced through the relay elements as follows: beginning at stem 12, hinge 19 and hinge gap 21, armature 20, the gap between the under surface of the latter element and surface 18 of flux concentrator section 17, the latter section proper, and pole-piece 11. Some flux will also close from the under surface of armature 20 through the last-mentioned air gap and contact 16 and some leakage flux will close from the end of armature 20. Since bumper member 23 is formed of a nonmagnetic material, no flux will close therethrough to interfere with the operation of armature 20.

The flexibility of hinge 19 permits the cross-sectional dimensions of armature 20 to be determined to provide sufficient flux carrying capacity at low reluctance to provide for proper switch operation. The concentration of flux at flux concentrator extension 17 ensures that the maximum tractile force on armature 20 is exerted by the generated field. As the end of armature 20 closes on contact 16, an electrical path is there closed through the mercury coating on the surface of armature 20. In accordance with one aspect of this invention, the movement of armature 20 about its hinge 19 is in a direction to increase its clearance with supporting stem 12, that is, movement of armature 20 is such as to angularly widen gap 21. As a result, the virtual abutment of the ends is permitted thereby advantageously initially reducing to a minimum the magnetic reluctance of gap 21 between these elements.

When the energizing current being applied to the winding (not shown) of the relay is terminated, armature 20 is withdrawn from contact with contact 16 as a result of the restoring spring action of hinge 19. As armature 20 retracts, a mercury bridge between the two elements is momentarily formed, which bridge is ruptured to break the electrical connection as is known. As armature 20 restores to its unoperated position, some oscillation of this member normally follows. As mentioned hereinbefore, in the past, without the provision of oscillation-dampening means, reestablishment of electrical contact was possible in the first and subsequent return swings of armature 20. In accordance with another aspect of this invention, oscillation of armature 20 is dampened and recontact prevented, at one point, by collision with bumper member 23. Adjustment of gap 24 between the latter member and armature 20 effectively reduces the first and subsequent rearward swings of armature 20 to prevent any recontact with contact 16 during armature oscillations. Further, bumper member 23 precludes any possibility of the armature being pulled toward the glass envelope by mercury which might become lodged between the armature and the envelope, thereby increasing the contact gap and the magnetic flux required to operate the switch.

What has been described is considered to be only one specific illustrative mercury-wetted relay construction according to the principles of this invention. Accordingly, it is to be understood that various and numerous other arrangements may be devised by one skilled in the art without departing from the spirit and scope of the invention as limited only as defined in the accompanying claims.

What is claimed is:

1. A mercury-wetted relay construction comprising a magnetic pole-piece member (11), a magnetic stem member (12), means (10) for oppositely supporting said stem and pole-piece members, said last-mentioned members presenting corresponding first and opposite, second sides, an electrical contact (16) mounted on the end and on said first side of, said pole-piece member (11), a substantially flattened "Z" shaped armature (20) presenting oppositely extending legs, and a magnetic hinge (19) for flexibly mounting said armature member (20) to said stem member (12) to extend one leg of said armature member in a spaced-apart relation over said contact (16), characterized in that said hinge (19) is affixed to the other, opposite leg of said armature member (20) to position said last-mentioned leg adjacent the end, and on said second side of, said stem member (12) and in that a nonmagnetic bumper member (23) is mounted on said first side of said stem member to extend along said one leg of said armature member (20) in a spaced relation with said one leg.

2. A mercury-wetted relay construction as claimed in claim 1 further characterized in that the end of said other leg of said armature member (20) is maintained by said hinge (19) in substantial abutment with the end of said stem member (12).

3. A mercury-wetted relay construction as claimed in claim 1 or 2, further characterized in that said means (10) comprises an insulated enclosure, said pole-piece member (11) and said stem member (12) extending externally from opposite ends of said enclosure (10) to form a pair of terminals (13, 14).

4. An armature arrangement for a mercury-wetted relay having oppositely supported pole-piece (11) and stem (12) members, said members lying substantially along a common longitudinal axis, said pole-piece member (11) having a contact (16) mounted at its end (15, 17) on one side of said axis, characterized in an armature member (20) supported by means of a flexible hinge (19) at the end of said stem member (12) at the opposite side of said axis, said armature member (20) extending across said axis to overlap said contact (16) in a spaced relation.

5. An armature arrangement for a mercury-wetted relay as claimed in claim 4, further characterized in that a bumper member (23) is provided for said armature member (20), said bumper member (23) being affixed to said stem member (12) at said one side of said axis and extending substantially parallel with said armature member (20) in a spaced relation therewith at the overlap of said contact (16).

6. An armature arrangement for a mercury-wetted relay as claimed in claim 4 or 5, further characterized in that said armature member (20) is supported in substantial abutment with said stem member (12).

7. An armature arrangement for a mercury-wetted relay having oppositely supported pole-piece and stem members (11, 12), said members lying substantially along a common longitudinal axis, said pole-piece member (11) having a contact (16) mounted at its end (15, 17) on one side of said axis, characterized in a bumper member (23) affixed to the end of said stem member (12) on said one side of said axis, said bumper member (23) extending in an overlapping and spaced relation with said contact (16), and an armature member (20) flexibly mounted at said end of said stem member (12) on the opposite side of said axis, said armature member (20) extending across said axis to parallel said bumper member (23) in an overlapping and spaced relation between said contact (16) and said bumper member (23).

8. A magnetically responsive, mercury-wetted relay construction comprising a magnetic stem member having a terminal end, a magnetic pole-piece member having a terminal end and a contact mounted on one surface at the other end, means for oppositely supporting said stem and pole-piece members at said terminal ends along a substantially common longitudinal axis, an armature member having one end offset from the other end, a magnetic hinge for flexibly mouting one end of said armature member on the other end of said stem member on one surface to extend said other end of said armature member across said axis in an overlapping and spaced relation with said contact, and a bumper member mounted on said other end of said stem member on its opposite surface and extending in a parallel and spaced relation with said other end of said armature member.

* * * * *

UNITED STATES PATENT AND TRADEMARK OFFICE

CERTIFICATE OF CORRECTION

PATENT NO. : 4,188,601

DATED : February 12, 1980

INVENTOR(S) : Larry Lee Wiese

It is certified that error appears in the above-identified patent and that said Letters Patent are hereby corrected as shown below:

In the Abstract, Line 4, "(11)" should read --(12)--; line 6, "(12)" should read --(11)--; line 10 "(11)" should read --(12)--; line 13, "(11)" should read --(12)--.

Column 8, Claim 8, line 18 "mouting" should read --mounting--.

Signed and Sealed this

*First* Day of *July 1980*

[SEAL]

*Attest:*

SIDNEY A. DIAMOND

*Attesting Officer*

*Commissioner of Patents and Trademarks*